US006150593A

United States Patent [19]

Holden

[11] Patent Number: 6,150,593

[45] Date of Patent: Nov. 21, 2000

[54] MUSICAL WIND INSTRUMENT REED HAVING PROTECTIVE COVER

[76] Inventor: Bernard Holden, 24 Squarey Street, Tooting London SW17 0AB, United Kingdom

[21] Appl. No.: 09/365,038

[22] Filed: Jul. 30, 1999

[51] Int. Cl.[7] ..... G10D 9/02

[52] U.S. Cl. ..... 84/383 R; 84/383 A; 84/380 R

[58] Field of Search ..... 84/383 A, 380 R, 84/383 R

[56] References Cited

U.S. PATENT DOCUMENTS

| | | | |
|---|---|---|---|
| D. 277,967 | 3/1985 | Gholson, Jr. | D17/13 |
| D. 367,074 | 2/1996 | Gholson, Jr. | D17/13 |
| 1,757,871 | 5/1930 | Miller | 84/383 R |
| 1,783,824 | 12/1930 | Brenner | 84/383 A |
| 2,022,736 | 12/1935 | Prescott | 84/383 A |
| 2,069,784 | 2/1937 | Topor | 84/383 R |
| 3,420,132 | 1/1969 | Backus | 84/383 A |
| 4,014,241 | 3/1977 | Gamble | 84/383 A |
| 5,192,821 | 3/1993 | Goldstein et al. | 84/383 R |

FOREIGN PATENT DOCUMENTS

| | | |
|---|---|---|
| 740579 | 1/1933 | France . |
| 2649236 | 1/1991 | France . |
| 247013 | 2/1947 | Switzerland . |

*Primary Examiner*—Stanley J. Witkowski
*Assistant Examiner*—Tim Lockett

[57] ABSTRACT

A reed enhancing device is provided which is adapted for use with a musical instrument including a hollow mouthpiece, a reed, and a ligature removably secured about the mouthpiece and the reed. The device includes a piece of material adapted for being positioned between the ligature and the reed.

3 Claims, 2 Drawing Sheets

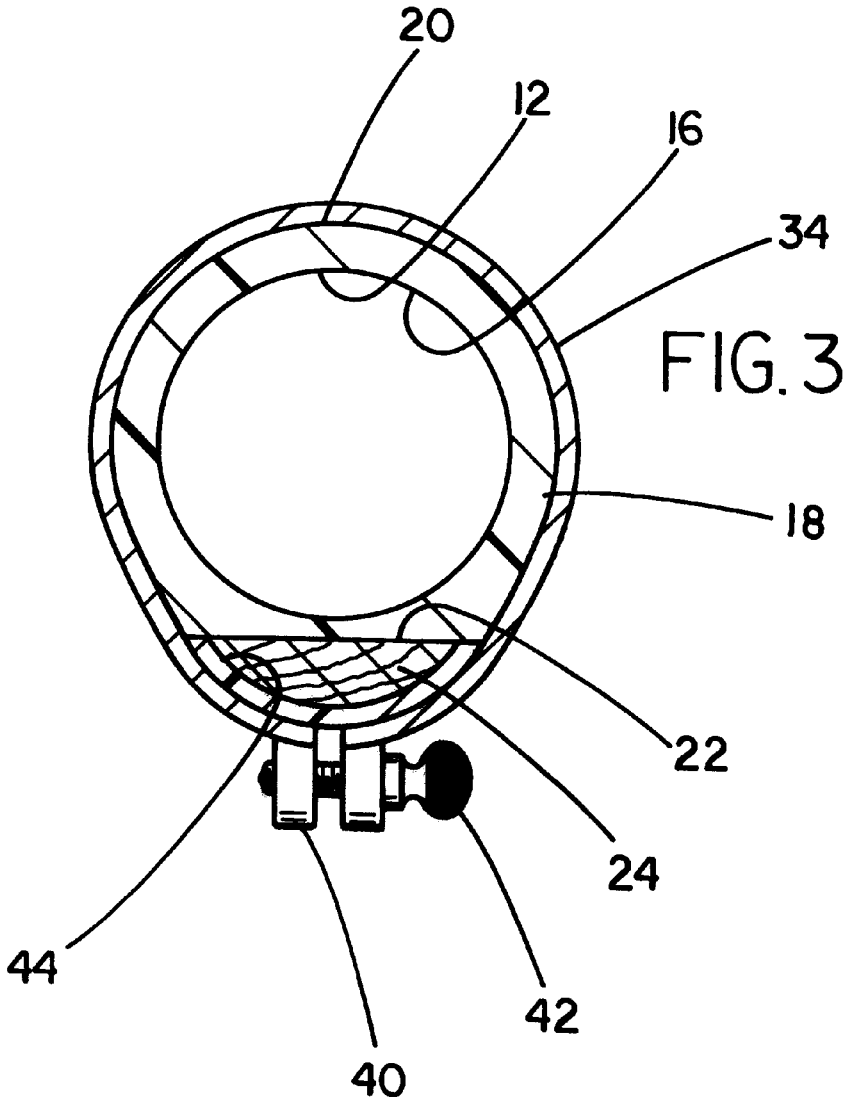
FIG. 3
FIG. 4
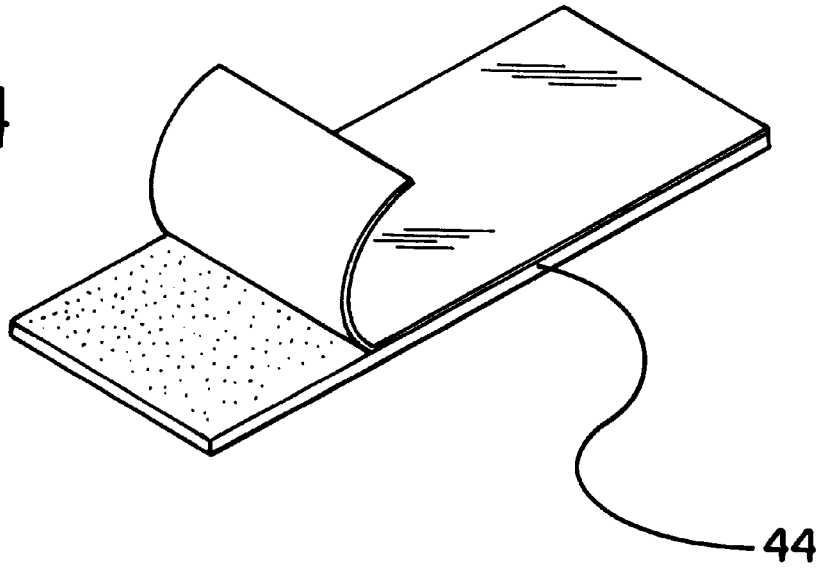

MUSICAL WIND INSTRUMENT REED HAVING PROTECTIVE COVER

BACKGROUND OF THE INVENTION

1. Field of the Invention

The present invention relates to musical instrument reeds and more particularly pertains to a new musical instrument reed enhancing device for enhancing the operability of a reed of a musical instrument.

2. Description of the Prior Art

The use of musical instrument reeds is known in the prior art. More specifically, musical instrument reeds heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 2,069,784; U.S. Pat. No. 1,757,871; U.S. Pat. No. 5,192,821; U.S. Pat. No. 2,022,736; U.S. Pat. Des. No. 367,074; and U.S. Pat. Des. No. 277,967.

In these respects, the musical instrument reed enhancing device according to the present invention substantially departs from the conventional concepts and designs of the prior art, and in so doing provides an apparatus primarily developed for the purpose of enhancing the operability of a reed of a musical instrument.

SUMMARY OF THE INVENTION

In view of the foregoing disadvantages inherent in the known types of musical instrument reeds now present in the prior art, the present invention provides a new musical instrument reed enhancing device construction wherein the same can be utilized for enhancing the operability of a reed of a musical instrument.

The general purpose of the present invention, which will be described subsequently in greater detail, is to provide a new musical instrument reed enhancing device apparatus and method which has many of the advantages of the musical instrument reeds mentioned heretofore and many novel features that result in a new musical instrument reed enhancing device which is not anticipated, rendered obvious, suggested, or even implied by any of the prior art musical instrument reeds, either alone or in any combination thereof.

To attain this, the present invention is adapted for use with a musical instrument having a hollow substantially tubular mouthpiece. As shown in FIG. 3, the mouthpiece has a cross-section with a circular inner periphery and an outer periphery having a circular portion and a planar portion. Also provided is a reed including an inboard extent with a substantially semi-cylindrical configuration defined by an arcuate portion and a planar portion. Associated therewith is an outboard extent with a substantially planar rectangular configuration. FIGS. 1 & 3 show a ligature including an arcuate top with a pair of side edges each having a pair of arcuate arms coupled thereto and extending therefrom. Ends of a first pair of the arcuate arms are equipped with a threaded bore and ends of a second pair of the arcuate arms each includes a bolt rotatably coupled thereto. Such bolts serve for removably coupling with one of the threaded bores. By this structure, the ligature is adapted to be secured about the mouthpiece and about the inboard extent of the reed. As such, the planar portion of the inboard extent of the reed resides along the planar portion of the outer periphery of the mouthpiece. Finally, a substantially planar flexible sheet of plastic is provided with a rectangular periphery encompassing an area equal to an area of the arcuate portion of the inboard extent of the reed. The sheet has a face covered with adhesive for adhering to the arcuate portion of the outer periphery of the inboard extent of the mouthpiece. As shown in FIG. 3, the sheet remains between the ends of the arms of the ligature and the reed.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is another object of the present invention to provide a new musical instrument reed enhancing device which may be easily and efficiently manufactured and marketed.

It is a further object of the present invention to provide a new musical instrument reed enhancing device which is of a durable and reliable construction.

An even further object of the present invention is to provide a new musical instrument reed enhancing device which is susceptible of a low cost of manufacture with regard to both materials and labor, and which accordingly is then susceptible of low prices of sale to the consuming public, thereby making such musical instrument reed enhancing device economically available to the buying public.

Still yet another object of the present invention is to provide a new musical instrument reed enhancing device which provides in the apparatuses and methods of the prior art some of the advantages thereof, while simultaneously overcoming some of the disadvantages normally associated therewith.

Still another object of the present invention is to provide a new musical instrument reed enhancing device for enhancing the operability of a reed of a musical instrument.

Even still another object of the present invention is to provide a new musical instrument reed enhancing device that is adapted for use with a musical instrument including a hollow mouthpiece, a reed, and a ligature removably secured about the mouthpiece and the reed. The device includes a piece of material adapted for being positioned between the ligature and the reed.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a cross-sectional view of the present invention taken along line 3—3 shown in FIG. 1.

FIG. 4 is a perspective view of the sheet of plastic of the present invention.

DESCRIPTION OF THE PREFERRED EMBODIMENT

Figure 1:
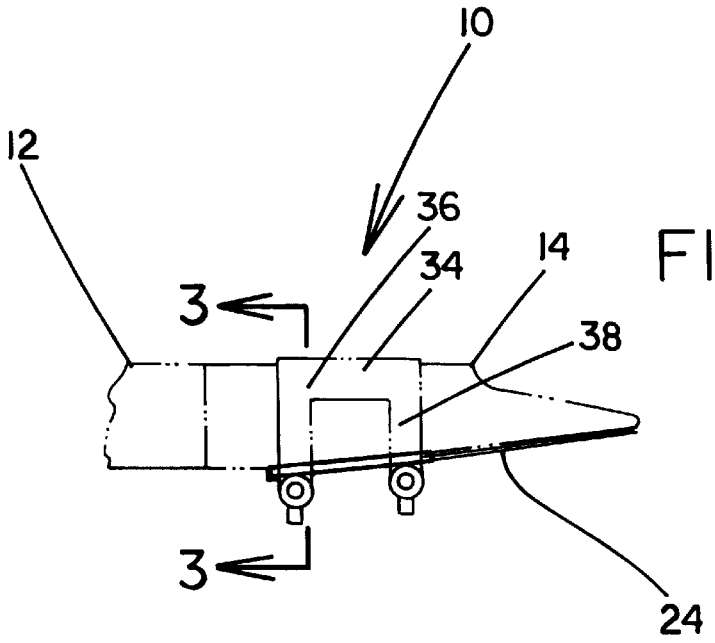
FIG. 1 is a side view of a new musical instrument reed enhancing device according to the present invention.
Figure 2:
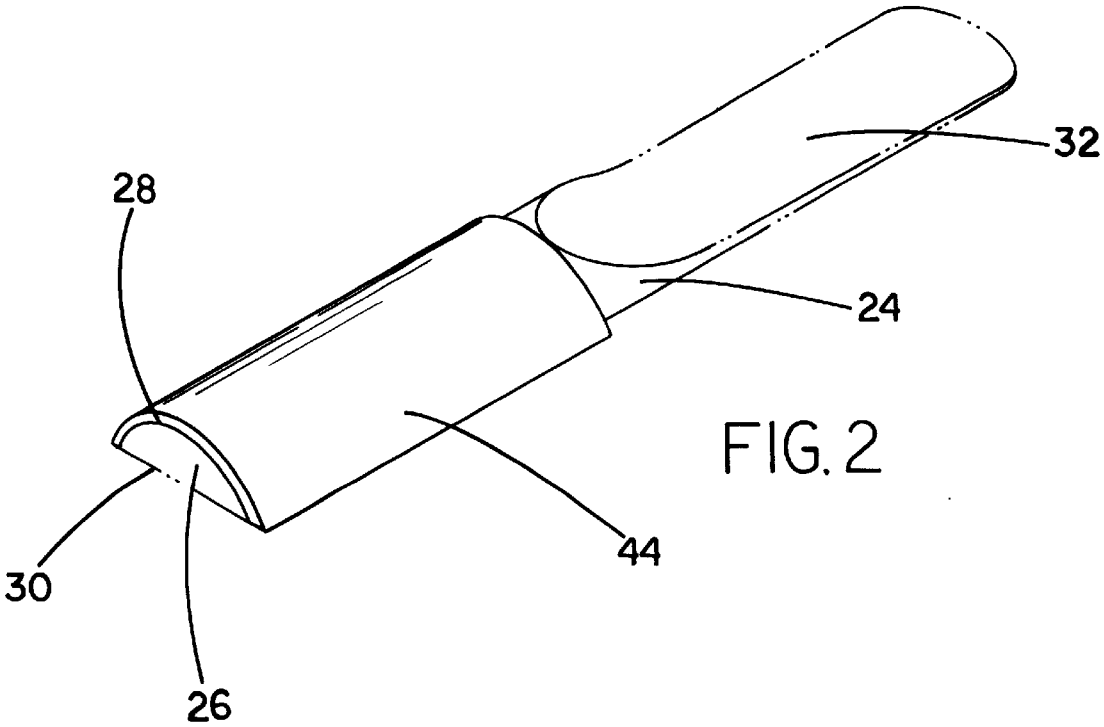
FIG. 2 is a perspective view of the present invention.

With reference now to the drawings, a new musical instrument reed enhancing device embodying the principles and concepts of the present invention and generally designated by the reference numeral 10 will be described.

The present invention, designated as numeral 10, is adapted for use with a musical instrument 12 such as a clarinet or saxophone having a hollow substantially tubular mouthpiece 14. As shown in FIG. 3, the mouthpiece has a cross-section with a circular inner periphery 16 and an outer periphery 18 having a circular portion 20 and a planar portion 22.

Also provided is a reed 24 including an inboard extent 26 with a substantially semi-cylindrical configuration defined by an arcuate portion 28 and a planar portion 30. Associated therewith is an outboard extent 32 with a substantially planar rectangular configuration.

FIGS. 1 & 3 show a metal ligature 34 including an arcuate top 36 with a pair of side edges each having a pair of arcuate arms 38 coupled thereto and extending therefrom. Ends of a first pair of the arcuate arms are each equipped with a threaded bore 40 and ends of a second pair of the arcuate arms each includes a bolt 42 rotatably coupled thereto. Such bolts serve for removably coupling with one of the threaded bores. By this structure, the ligature is adapted to be secured about the mouthpiece and about the inboard extent of the reed. As such, the planar portion of the inboard extent of the reed resides along the planar portion of the outer periphery of the mouthpiece.

Finally, a substantially planar flexible sheet of plastic 44 is provided with a rectangular periphery encompassing an area equal to an area of the arcuate portion of the inboard extent of the reed. Ideally, the sheet has a length of 34 mm and a width of 15 mm. The sheet has a face covered with adhesive for adhering to the arcuate portion of the outer periphery of the inboard extent of the reed such that the peripheries thereof are coextensive. As an option, a waxed paper backing may be removably positioned over the adhesive prior to use. As shown in FIG. 3, the sheet remains between the ends of the arms of the ligature and the reed in use. In the preferred embodiment, the sheet of plastic has a uniform thickness of about 1 mm which is about equal to that of the ligature.

The method associated with the present invention includes first providing each of the foregoing components and positioning the sheet of plastic between the ligature and the reed prior to use. In operation, the sheet of plastic provides an insulation between the metal ligature and the reed for allowing the reed to vibrate evenly, thereby improving the overall tone and playing response of the instrument. Damage to the reed would also be prevented in case the ligature was to be over-tightened.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

I claim:

1. A musical instrument reed enhancing system comprising, in combination:

a musical instrument including a hollow substantially tubular mouthpiece having a cross-section with a circular inner periphery and an outer periphery with a circular portion and a planar portion;

a reed including an inboard extent with a substantially, semi-cylindrical configuration defined by an arcuate portion and a planar portion and an outboard extent with a substantially planar rectangular configuration;

a ligature including an arcuate top with a pair of side edges each having a pair of arcuate arms coupled thereto and extending therefrom, wherein ends of a first pair of the arcuate arms each includes a threaded bore and a second pair of the arcuate arms each includes a bolt rotatably coupled thereto for removably coupling with one of the threaded bores, the ligature being adapted to be secured about the mouthpiece and about the inboard extent of the reed such that the planar portion of the inboard extent of the reed resides along the planar portion of the outer periphery of the mouthpiece; and a substantially planar flexible sheet of plastic with a rectangular periphery encompassing an area equal to an area of the arcuate portion of the inboard extent of the reed, wherein the flexible sheet has a length of about 34 mm and a width of about 15 mm, and a uniform thickness of about 1 mm, the flexible sheet having a face covered with adhesive adhering the flexible sheet to the arcuate portion of the outer periphery of tie inboard extent of the reed such that the flexible sheet remains between the ends of the arms of the ligature and the reed.

2. A reed enhancing device adapted for use with a musical instrument including a hollow mouthpiece, a reed, and a ligature removably secured about the mouthpiece and the reed, the device comprising:

a piece of material adapted for being positioned between the ligature and the reed, the piece of material comprising, a substantially planar flexible sheet of plastic with a rectangular periphery encompassing an area equal to an area of the arcuate portion of the inboard extent of the reed, wherein the flexible sheet has a length of about 34 mm and a width of about 15 mm, and a uniform thickness of about 1 mm, the flexible sheet having a face covered with adhesive adhering the flexible sheet to the arcuate portion of the outer periphery of the inboard extent of the reed such that the flexible sheet remains between the ends of the arms of the ligature and the reed.

3. A method of enhancing the operation of a musical instrument comprising the acts of:

providing a musical instrument including a hollow mouthpiece;

providing a reed;

providing a ligature;

providing a piece of material, the piece of material comprising a substantially planar flexible sheet of plastic with a rectangular periphery encompassing an area equal to an area of the arcuate portion of the inboard extent of the reed, wherein the flexible sheet has a length of about 34 mm and a width of about 15 mm, and a uniform thickness of about 1 mm, the flexible sheet having a face covered with adhesive;

adhering the flexible sheet to the arcuate portion of the outer periphery of the inboard extent of the reed; and securing the ligature about the mouthpiece and the reed with the piece of material located between the ligature and the reed.

* * * * *